US006230992B1

(12) United States Patent
Arndt et al.

(10) Patent No.: US 6,230,992 B1
(45) Date of Patent: May 15, 2001

(54) PERFORATED DISK OR ATOMIZING DISK AND AN INJECTION VALVE WITH A PERFORATED DISK OR ATOMIZING DISK

(75) Inventors: Stefan Arndt, Stuttgart; Martin Maier, Möglingen; Jörg Heyse, Markgröningen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/308,484

(22) PCT Filed: Sep. 10, 1998

(86) PCT No.: PCT/DE98/02674

§ 371 Date: Jul. 19, 1999

§ 102(e) Date: Jul. 19, 1999

(87) PCT Pub. No.: WO99/14487

PCT Pub. Date: Mar. 25, 1999

(30) Foreign Application Priority Data

Sep. 16, 1997 (DE) ..... 197 40 882
Jul. 16, 1998 (DE) ..... 198 31 845

(51) Int. Cl.[7] ..... B05B 1/30; B05B 1/00; B05B 7/06

(52) U.S. Cl. ..... 239/585.1; 239/596; 239/424.5

(58) Field of Search ..... 239/585.1, 596, 239/417.3, 424.5

(56) References Cited

U.S. PATENT DOCUMENTS

| | | | | |
|---|---|---|---|---|
| 4,907,748 | | 3/1990 | Gardner et al. | 239/584 |
| 5,148,788 | | 9/1992 | Saikalis et al. | 123/339.27 |
| 5,402,937 | | 4/1995 | Buchholz et al. | 239/431 |
| 5,766,441 | * | 6/1998 | Arndt et al. | 205/170 |
| 5,899,390 | * | 5/1999 | Arndt et al. | 239/585.1 X |
| 5,921,474 | * | 7/1999 | Zimmermann et al. | 239/585.1 X |
| 5,924,634 | * | 7/1999 | Arndt et al. | 239/585.1 X |
| 5,976,342 | * | 11/1999 | Arndt et al. | 205/170 |
| 5,996,911 | * | 12/1999 | Gesk et al. | 239/585.1 X |

FOREIGN PATENT DOCUMENTS

| | | |
|---|---|---|
| 43 31 851 | 3/1995 | (DE) . |
| 43 33 519 | 4/1995 | (DE) . |
| 196 07 288 | 10/1996 | (DE) . |
| 0 354 660 | 2/1990 | (EP) . |
| WO 95/25889 | 9/1995 | (WO) . |

* cited by examiner

*Primary Examiner*—David A. Scherbel
*Assistant Examiner*—Davis Hwu
(74) *Attorney, Agent, or Firm*—Kenyon & Kenyon

(57) ABSTRACT

A perforated disk has a complete passage for a fluid and composed of an inlet opening, outlet openings, and at least one cavity positioned between them. The at least three functional plates of the perforated disk, each of which has a characteristic opening structure, are applied onto one another by electrodeposition (multilayer electroplating) so that the perforated disk is composed of a single piece. Gas supply openings through which a gas can be supplied in the direction of the fluid to be sprayed are located in the lower functional plate, thus providing very fine atomization of the fluid. The outlet openings are part of the gas supply openings. The perforated disk is especially suitable for use in injection valves for mixture-compressing internal combustion engines with externally supplied ignition.

28 Claims, 4 Drawing Sheets

PERFORATED DISK OR ATOMIZING DISK AND AN INJECTION VALVE WITH A PERFORATED DISK OR ATOMIZING DISK

BACKGROUND INFORMATION

The production of nozzles in the form of perforated disks representing "S-type disks" is described in European Patent Application No. 0 354 660. According to this method, the inlet and outlet openings in the perforated disk are offset from one another, thus inevitably producing an "S pattern" in the flow of a fluid passing through the perforated disk. The proposed perforated disks are formed by two flat silicon wafers that are bonded together. Regions with a reduced thickness are provided on the silicon wafers so that shearing gaps are formed between the openings of the first wafer and the one opening of the second wafer parallel to the end faces of the wafers. The silicon wafers, which have a large number of perforated disk structures, are etched using known photomasking techniques, thus creating the inlet and outlet openings. The truncated tapered contours of the openings in the perforated disk logically result from the non-isotropic etching technique.

A fuel injection valve that has a nozzle composed of two silicon wafers on its downstream end is described in U.S. Pat. No. 4,907,748. As with the perforated disks described above, the inlet and outlet openings in the two silicon wafers are offset from one another, thus producing an "S pattern" in the flow of a fluid passing through the disk, which is fuel in this case.

In addition, perforated disks composed of two or three connected silicon wafers are described in German Patent Application No. 43 31 851. In this publication, an upper inlet opening in the upper wafer is followed by multiple outlet openings in the lower wafer with complete coverage. The perforated disks are provided for spraying a fuel-gas mixture with gas inflow channels from which a gas strikes the fuel to be sprayed largely perpendicularly.

All of the above-described perforated disks made of silicon have the disadvantage that they may not be sufficiently resistant to fracture because silicon is brittle. Especially when permanent loads are placed, e.g., on an injection valve (engine vibrations), there is the danger that the silicon wafers will break. Mounting the silicon wafers on metal components, such as injection valves, is complicated, since special stress-free clamping solutions must be found, and sealing the valve is problematic. It is not possible, for example, to weld the silicon perforated disks onto the injection valve. There is the further disadvantage of the edges of the openings in the silicon disks being worn away by the frequent passage of fluid.

The provision of a spray disk having multiple spray holes as well as an atomizer disk located further downstream is described in International Patent Publication No. 95/25889. The spray holes are provided in a central conical depression in the spray disk. This spray disk is followed by a completely separate atomizer disk, which is composed of multiple layers or wafers and into which air flows from the outside through a special opening geometry. The stainless steel wafers of the atomizer disk have an inner, central passage in which the air strikes, largely perpendicularly, the fuel emerging from the spray holes of the spray disk.

SUMMARY OF THE INVENTION

The perforated disk or atomizer disk according to the present invention and the injection valve according to the present invention have the advantage that especially uniform, extremely fine atomization of a fluid can be provided with the aid of a gas, thus achieving an especially high atomization quality and a jet shape that is adjusted to the requirements at hand. Consequently, the use of a perforated disk or atomizer disk of this type on an injection valve of an internal combustion engine makes it possible, among other things, to reduce the exhaust emissions of the internal combustion engine and also reduce fuel consumption.

Using electrodeposition techniques, it is possible to advantageously produce in a reproducible manner a very high volume of perforated disks or atomizer disks extremely precisely and economically. This production method also permits a very large amount of design flexibility because the contours of the openings in the perforated disk can be freely selected. Particularly in comparison to the production of silicon disks, electrodeposition has the advantage that a wide variety of materials can be used. The many different metals with their various magnetic characteristics and hardnesses can be used for producing the perforated disk or atomizer disk according to the present invention.

Multilayer electroplating makes it possible in an especially advantageous manner to produce recesses economically and with extreme precision.

Another advantage is that the perforated disks produced by electrodeposition are designed in one piece, since the individual functional plates are built upon each other in directly subsequent deposition steps. After electrodeposition, the perforated disk is in one piece; this means that no time and cost-intensive process steps are needed for joining the individual nozzle wafers. This also eliminates problems which can arise when centering or positioning individual wafers in relation to each other in multi-piece perforated disks.

An arrangement for supplying gas can be advantageously provided very easily and at no additional expense in a perforated disk or atomizer disk of this type produced by electrodeposition. Gas flows through this gas supply arrangement in the direction of the fuel to be sprayed, atomizing the fuel especially finely. In addition to optimum preparation and atomization of the fuel, the gas inflow pulse also affects the direction of the fuel jet at the outlet. A high impulse, for example, causes the enveloping angle of a conical fuel jet to decrease. This effect can be used to control the jet shape according to load. With a low engine load, at which a vacuum is produced in the intake manifold due to the throttle valve position, the driving pressure drop for the surrounding gas is high, restricting the jet volume. With a high engine load, broader jet patterns with larger cone angles can be produced in this manner. Depending on the local distribution of the fuel input into the combustion chamber of an internal combustion engine, a level of combustion that is ideal for the working load can be achieved by the gas-controlled influence on the jet pattern. Selecting different opening geometries in the perforated disk makes it possible to influence this jet pattern even when spraying a fan jet or using an asymmetrical jet shape.

It is also advantageous to design the perforated disks according to the present invention in the form of S-type disks so that exotic, unusual jet shapes can be produced. These perforated disks provide countless variations of jet cross-sections for one-, two-, and multi-jet sprays, including rectangles, triangles, crosses, and ellipses. These unusual jet shapes allow the spray to be optimally adjusted precisely to predetermined geometries, e.g., to different intake manifold cross-sections of internal combustion engines. This makes it possible to advantageously customize the use of the available cross-section to homogeneously distribute the injected mixture in a manner that reduces emissions and to avoid harmful film deposits on the wall of the intake manifold caused by exhaust gas.

The jet pattern can be easily varied. For example, it is simple to produce flat or conical jet patterns, those that include multiple individual jets, and asymmetrical jet patterns (directed to one side).

An asymmetrical, e.g., one-sided, gas supply can very effectively divert the fuel jet to one side. This can be advantageous if fuel is to be always sprayed onto an intake valve at a specific angle each time a working load is applied.

It is also advantageous to design the atomizer disks according to the present invention in the form of swirl disks in order to achieve especially effective atomization of the fluid to be sprayed. Because the gas supply openings as a means for supplying the gas empty into the outlet opening tangentially rather than radially, an additional swirling motion can be produced in the gas as well. This swirling motion can rotate in the same direction as the swirling motion of the fuel or in the opposite direction. If the swirling motion moves in the opposite direction, the highest relative velocities occur between the rotating gas stream and the rotating jet surface. This is particularly helpful in breaking down the fuel jet into small droplets.

The means for supplying gas are ideally designed in the form of gas supply openings which also form outlet openings for the fuel at their inner ends facing away from the circumference of the perforated disk, with the size of the outlet openings being determined by the material of the functional plate electrodeposited on top of it. This in no way results in additional cost compared to producing perforated disks that have only outlet openings but no means for supplying gas on the lower plane.

DETAILED DESCRIPTION

Figure 1:
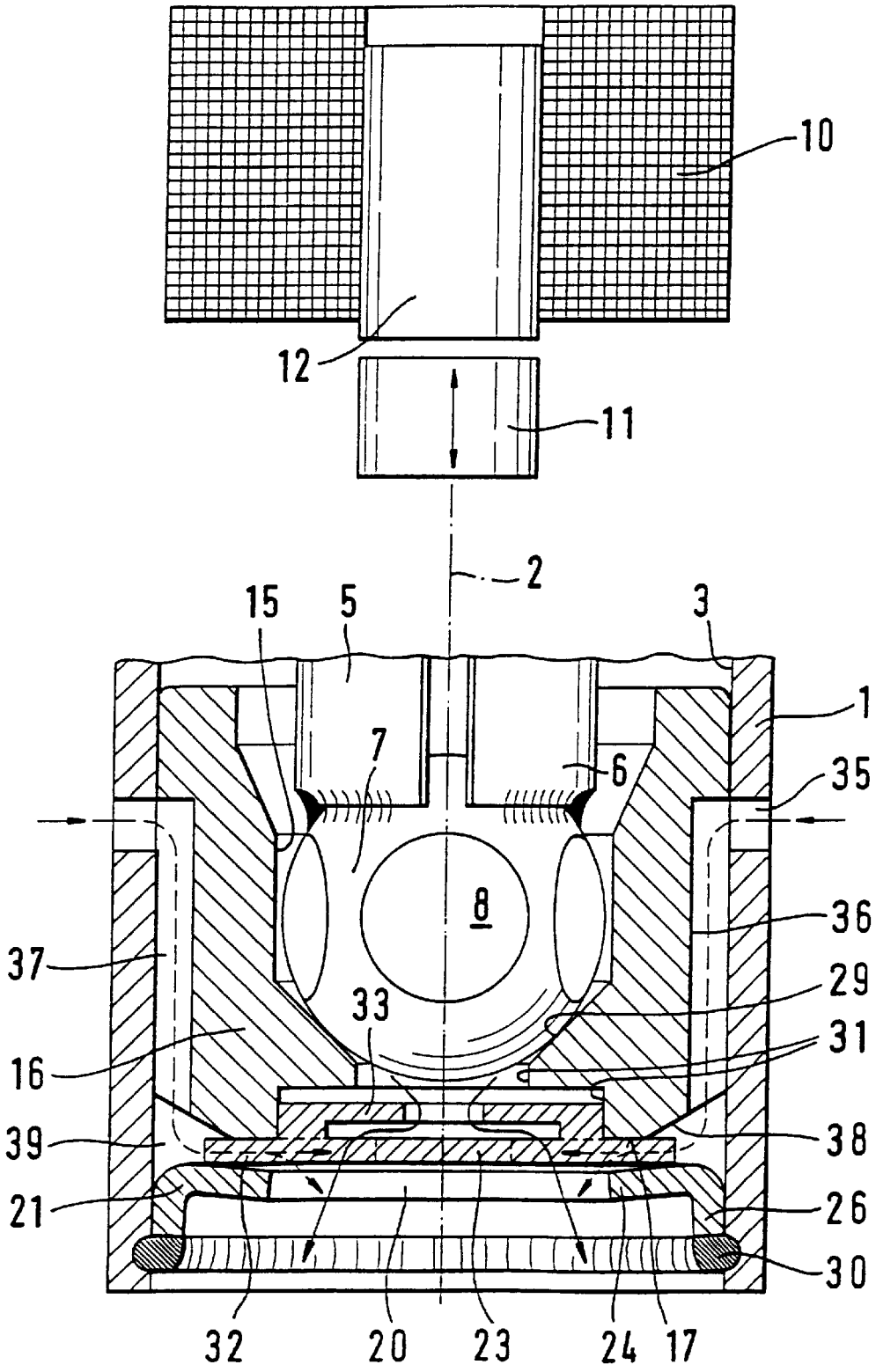
FIG. 1 shows a partial illustration of a first exemplary embodiment of an injection valve with a perforated disk according to the present invention.

FIG. 1 shows a partial view of one embodiment of an injection valve for fuel injection systems of mixture-compressing internal combustion engines with externally supplied ignition. The injection valve has a tubular valve seat carrier 1 in which a longitudinal opening 3 is provided concentrically in relation to a longitudinal valve axis 2. In longitudinal opening 3 is positioned, for example, a tubular valve needle 5 whose downstream end 6 is fixedly connected, for example, to a spherical valve closing member 7 that has five flattened areas 8, for example, located along its circumference for allowing the fuel to flow by.

The injection valve is operated in a conventional manner, for example, through electromagnetic means. A resetting spring (not shown) is used to move valve needle 5 in the axial direction, thus opening it against the force of the spring, and a schematically illustrated electromagnetic circuit with a solenoid 10, an armature 11, and a core 12, is used to close the injection valve. Armature 11 is connected to the end of valve needle 5 facing away from valve closing member 7, e.g., by a welded seam produced by a laser and oriented toward core 12.

Valve closing member 7 is guided during its axial movement by a guide opening 15 of a valve seat body 16 which is mounted to form a seal in longitudinal opening 3 running concentrically to longitudinal valve axis 2 in the downstream end of valve seat carrier 1 facing away from core 12, for example by welding. Close to its lower end face 17 oriented away from valve closing member 7, a perforated disk holder 21, designed, for example, in the form of a cup, is positioned downstream from valve seat body 16. Perforated disk holder 21 has a shape that is similar to a conventional cup-shaped spray disks, with a central area of perforated disk holder 21 being provided with a passage 20 without a metering function.

A perforated disk 23 according to the present invention is positioned upstream from passage 20 on lower end face 17 so that it completely covers passage 20. Perforated disk 23 is an insert that can be positioned between valve seat body 16 and perforated disk holder 21. Perforated disk holder 21 is designed with a base 24 and a retaining edge 26. Retaining edge 26 extends in the axial direction away from valve seat body 16 and curves outward conically toward its end. In the region of retaining edge 26, perforated disk holder 21 is attached to the wall of longitudinal opening 3 ii valve seat carrier 1, for example by a circumferential welded seam 30 that forms a seal.

Perforated disk 23, which can be clamped between perforated disk holder 21 and valve seat body 16 in the region of passage 20 is designed, for example, in segments. An upper perforated disk area 33 that has a smaller diameter than a base area 32 extends, accurate to size, into an outlet opening 31 of valve seat body 16 that is, for example, designed in segments and located downstream from a valve seat surface 29. Outlet opening 31 can also be designed simply as a cylinder without segments. This region encompassing perforated disk area 33 and outlet opening 31 can also be designed with an interference fit. Base area 32 of perforated disk 23, which projects radially over perforated disk area 33 and can thus be clamped in place, lies against lower end face 17 of valve seat body 16 as well as base 24 of perforated disk holder 21. While perforated disk area 33 encompasses, for example, two functional plates, namely a middle and an upper functional plate of perforated disk 23, a lower functional plate alone forms base area 32. A functional plate is an area of perforated disk 23 extending in the axial direction which has a largely constant opening contour along its axial length.

The depth at which valve seat body 16 or cup-shaped perforated disk holder 21 slides into longitudinal opening 3 determines the size of the stroke of valve needle 5, since one end position of valve needle 5 is established when valve closing member 7 comes to rest against valve seat surface 29 of valve seat body 16 while solenoid 10 is not excited. The other end position of valve needle 5 is established, for example, when armature 11 comes to rest against core 12 while solenoid 10 is excited. The distance between these two end positions of valve needle 5 thus represents the stroke. Spherical valve closing member 7 interacts with valve seat surface 29 of valve seat body 16, which is tapered in a conically truncated manner in the direction of flow and is provided in the axial direction between guide opening 15 and lower outlet opening 31 of valve seat body 16.

Valve seat carrier 1, valve seat body 16, and perforated disk 23 are designed so that a gas, in particular air, can be supplied to the fluid to be sprayed through perforated disk 23, e.g., a fuel. The gas used can be, for example, the suction air diverted through a bypass upstream from a throttle valve in the intake manifold of the internal combustion engine, air conducted through an additional blower, air that has been enriched with fuel vapor from a tank ventilation system, as well as recycled exhaust gas of the internal combustion engine or a mixture of air and exhaust gas. Multiple inflow openings 35 extending in a radial direction are provided, for example, in valve seat carrier 1 for supplying the gas.

Valve seat body 16 has, on its circumference, at least one, but usually at least two, groove-like depressions 36 extending in the axial direction, with these depressions 36 being limited to the outside by the wall of longitudinal opening 3 of valve seat carrier 1, thus forming flow channels 37 for the gas. Depressions 36 begin at the height of inflow openings 35 and end at lower end face 17 of valve seat body 16 in an area where a chamfer 38 is provided to allow the gas to more easily flow into perforated disk 23. Instead of groove-like depressions 36, depressions 36 can also be designed as flat abrasions on the circumference of valve seat body 16. Downstream from lower end face 17 containing chamfer 38, the gas flow enters an annular chamber 39 which is limited by the inner wall of valve seat carrier 1, by perforated disk holder 21, and valve seat body 16. Inside this annular chamber 39, the gas flow is distributed largely uniformly across the circumference.

Lower base area 32 of perforated disk 23 is designed with an arrangement 43 (FIGS. 2 and 3) for supplying gas in the direction of its spray geometry, with the gas coming from flow channels 37 and annular chamber 39 entering this arrangement 43 and flowing therethrough largely perpendicular to longitudinal valve axis 2. The flow paths of the gas are illustrated by broken lines in FIG. 1, while the principle flow path of the fluid, or the final sprayed fluid-gas mixture, is represented by solid arrows.

Perforated disk 23, which is partially located in segmented outlet opening 31 of valve seat body 16 and held in place directly on end face 17 of valve seat body 16 by perforated disk holder 21 is illustrated in FIG. 1 in simplified form and as an example and is described in greater detail on the basis of the following drawings. The use of perforated disk 23 with a perforated disk holder 21 and clamping as the form of attachment is one possible method for attaching perforated disk 23 downstream from valve seat surface 29. A clamping method of this type for indirectly fastening perforated disk 23 to valve seat body 16 has the advantage that it avoids temperature-related deformations which can occur with processes such as welding or soldering when perforated disk 23 is attached directly. Perforated disk holder 21 is therefore by no means the only way to attach perforated disk 23. Because the possible attachment methods are not essential to the present invention, they are merely referred to as commonly known joining methods such as welding, soldering, and cementing.

Figure 2:
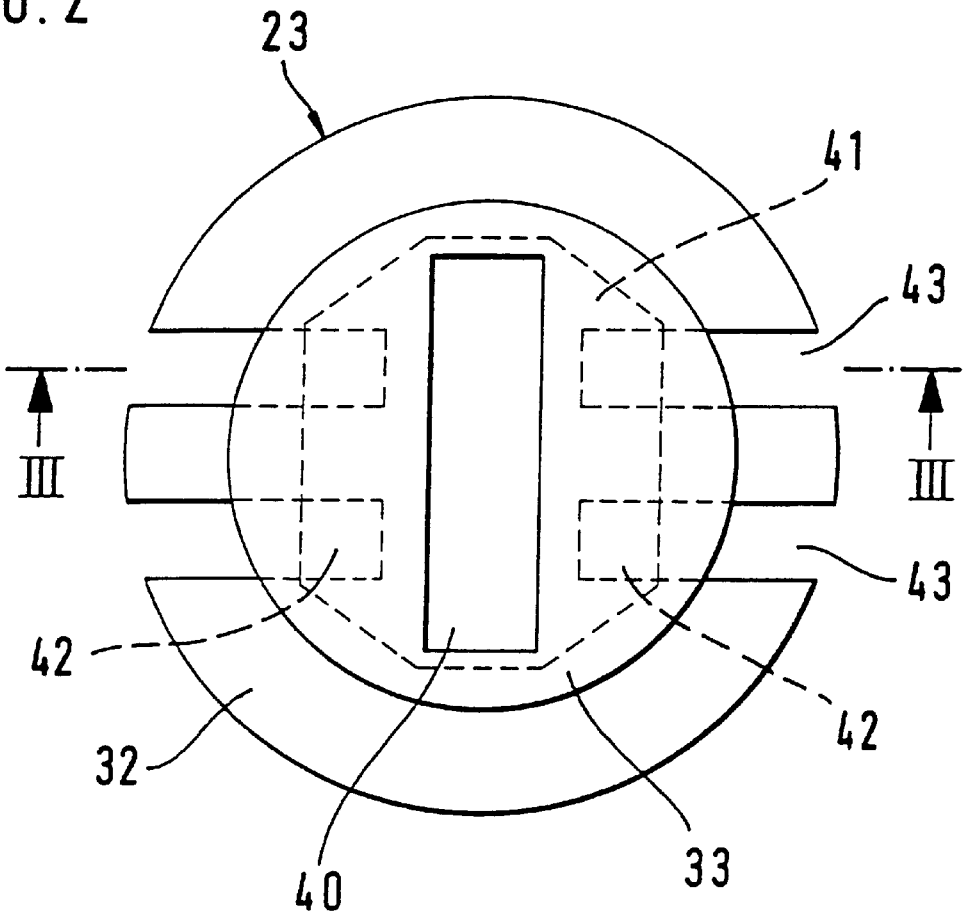
FIG. 2 shows a top view of the perforated disk illustrated in FIG. 1.
Figure 3:
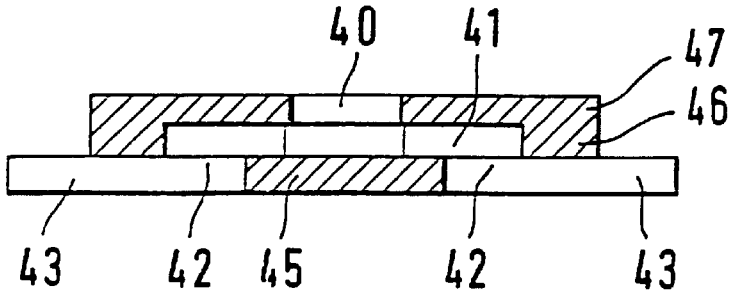
FIG. 3 shows a cutaway view along line III—III of the perforated disk illustrated in FIG. 2.

Perforated disk 23 illustrated in FIGS. 2 and 3 is constructed from multiple metallic functional plates by electrodeposition (multilayer electroplating). The production method using gravure lithography and electroplating provides special design features, some of which are summarized below:

Functional plates having a constant thickness over the entire disk surface;

largely perpendicular incisions in the functional plates due to the gravure lithographic patterning, with these incisions forming the hollow spaces through which the fluid flows (production-related deviations of approximately 3° over perfectly perpendicular walls can occur);

desired recesses and coverings over the incisions due to the multilayer construction of individually patterned metal layers;

incisions with any cross-sectional shape having walls that run largely parallel to the axis; and one-piece design of the perforated disk, since the individual metal layers are deposited directly upon one another.

At this point, a brief definition of terms is provided below, since the terms "layer" and "functional plate" are used. A functional plate of perforated disk 23 is a stratum along whose axial length the contour remains largely constant, including the arrangement of all openings in relation to one another and the geometry of each individual opening. A layer, on the other hand, is a stratum of perforated disk 23 that is deposited in a single electroplating step. However, a layer can include multiple functional plates, which can be produced, for example, by lateral overgrowth. Multiple functional plates (e.g., the middle and upper functional plates in a perforated disk 23 including three functional plates), which represent a cohesive layer, are formed in a single electroplating step. As mentioned above, however, the individual functional plates have different opening contours (inlet and outlet openings, channels) in the direction of the immediately adjacent functional plate. The individual layers of perforated disk 23 are electroplated consecutively, so that the subsequent layer bonds firmly to the underlying layer due to electroplating adhesion, and all layers together form a one-piece perforated disk 23. The individual functional plates or layers of perforated disk 23 are therefore not comparable to individually produced nozzle wafers made of metal or silicon in the case of known perforated disks according to the related art.

The following paragraphs provide a summary of the method for producing illustrated perforated disk 23. All electrodeposition process steps used in producing a perforated disk have already been explained in detail in German Patent Application No. 196 07 288, and this description applies here as well. Because of the high demands placed on the structural dimensions and precision of injection nozzles, micropatterning methods are becoming more and more important for mass production of these components. As a general rule, a path that facilitates the formation of turbulence in the flow, as mentioned above, is necessary in order for the fluid, e.g., the fuel, to flow within the nozzle or perforated disk. Characteristic of the method in which photolithographic steps (UV gravure lithography) are applied successively, followed by microelectroplating, is the fact that it guarantees a high level of structural precision even on a large scale, making it ideal for extremely high-volume mass production. A large number of perforated disks 23 can be produced simultaneously on a wafer.

The method starts with an even and stable substrate, which can be made for example of metal (titanium, copper), silicon, glass, or ceramic. At least one optional auxiliary layer is then electroplated onto the substrate. This can be, for example, an electroplated start layer (such as Cu) which is needed to provide electrical conduction for the later microelectroplating process. The electroplated start layer can also be used as a sacrificial layer to make it easier to separate the perforated disk structures later on by etching. The auxiliary layer (typically CrCu or CrCuCr) is applied, for example, by sputtering or de-energized deposition. After pre-treating the substrate in this manner, a photoresist is applied to the entire surface of the auxiliary layer.

The thickness of the photoresist should equal the thickness of the metal layer to be produced in the electroplating process that follows later on, i.e., it should equal the thickness of the lower layer or functional plate of perforated disk 23. The metal structure to be produced should be inversely transferred to the photoresist with the aid of a photolithographic mask. One way to do this is to expose the photoresist directly via the mask using UV exposure (UV gravure lithography).

The final negative pattern produced in the photoresist for the later functional plate of perforated disk 23 is electrically filled with metal (e.g., Ni, NiCo) by electrodeposition. The electroplating process lays the metal close to the contour of the negative structure, making it possible to reproduce the preset contours in a dimensionally accurate manner. To create the structure of perforated disk 23, the steps must be repeated from the optional application of the auxiliary layer, depending on the number of layers desired, with two functional plates, for example, being produced in a single electroplating step (lateral overgrowth). Different metals can also be used for the layers of a perforated disk 23, applying each one in a new electroplating step. Perforated disks 23 are then separated. To do this, the sacrificial layer is etched away, lifting perforated disks 23 away from the substrate. The electroplated start layers are then etched away, and the remaining photoresist removed from the metal patterns.

FIG. 2 shows a preferred embodiment of a perforated disk 23, viewed from above. Perforated disk 23 is designed as a flat, circular component that has multiple, e.g., three, functional plates applied consecutively in the axial direction. FIG. 3, in particular, which shows a cutaway view along a line III—III of the representation illustrated in FIG. 2, illustrates the structure of perforated disk 23 and its three functional plates, with lower functional plate 45, which is applied first and corresponds to the first layer deposited or base area 32 of perforated disk 23, having a larger outer diameter than the two subsequently applied functional plates 46 and 47, which together form perforated disk area 33 and are produced, for example, in a single electroplating step.

Upper functional plate 47 has an inlet opening 40 with a rectangular cross-section. Four, e.g., square, outlet openings 42, into each of which a slot-shaped gas supply opening 43 empties, are positioned in lower functional plate 45 equidistant, for example, from longitudinal valve axis 2, and thus from the central axis of perforated disk 23, and arranged, for example, symmetrically around this central axis. Outlet openings 42 are provided along the two longitudinal sides of rectangular inlet opening 40, with outlet openings 42 being placed in a different functional plate 45. Starting at the outer circumference of base area 32 of perforated disk 23, four gas supply openings 43 with rectangular cross-sections are arranged parallel to or in alignment with each other and extend into the interior of perforated disk 23 all the way to end areas formed by outlet openings 42. Each outlet opening 42 thus forms the end of a gas supply opening 43 located at a distance from the outer circumference of perforated disk 23. In the section of base area 32 projecting radially over perforated disk area 33, gas supply openings 43 are largely covered by valve seat body 16 and perforated disk holder 21, creating gas supply channels.

With all functional plates 45, 46, 47 projecting, square outlet openings 42 lie on a plane (FIG. 2) that is offset from inlet opening 40, i.e., inlet opening 40 does not cover outlet openings 42 at any point in the projection. The size of the offset can, however, be varied in different directions.

To ensure that the fluid flows from inlet opening 40 to outlet openings 42, a channel 41 representing a cavity is provided ir middle functional plate 46. Cavity 41, which has the contour of an asymmetrical octagon, is large enough to completely cover inlet opening 40 in the projection. Cavity 41 is even large enough that it covers all outlet openings 42 in the projection. As a result, the fluid flow can largely enter from all points along the circumference of each outlet opening 42, due to the cavity wall that projects on at least three sides of outlet openings 42, with the cavity wall projecting directly over the sides of outlet openings 42 facing away from inlet opening 40. The material of middle functional plate 46 also covers a portion of gas supply openings 43 in the direction of gas flow downstream from valve seat body 16. The subsequent sections of gas supply openings 43 that are not covered, due to cavity 41, form outlet openings 42 and thus the metering outlet cross-sections for the fuel flow.

The preferably perpendicular walls of all opening areas 40, 41, 42, and 43 shown in FIG. 3 can have production-related deviations amounting to a total of around 3° to 4°, so that all opening areas 40, 41, 42, and 43 may how slightly tapered variations from the perpendicular in the angle areas described above, viewed from the direction of flow.

With a diameter of around 2 to 2.5 mm, perforated disk 23 has a thickness, for example, of 0.3 mm, with all functional plates 45, 46, and 47 being, for example, 0.1 mm thick. Middle functional plate 36 in particular, with its channels 41 in the form of cavities, are the most likely to be designed with a functional plate 46 of variable thicknesses in different embodiments, thus making it possible to easily influence the flow by changing the ratio of the offset between inlet and outlet openings 40 and 42 and the height of cavity 41. These sizes in the dimensions of perforated disk 23 serve only to provide a better understanding of the concept and in no way limit the present invention. The relative dimensions of the individual structures of perforated disk 23 in all figures are not necessarily true to scale, since the layer thicknesses must be shown with a relative amount of enlargement in the magnitudes mentioned above, as compared to other components.

The above-described offset between outlet openings 42 and at least one inlet opening 40 produces an S-shaped flow variation of the medium, for example the fuel, which is why these perforated disks 23 are S-type disks. Cavity 41 running in a radial direction gives the medium a radial velocity component. The flow does not completely lose its radial velocity component in the short axial outlet passage. Instead it exits perforated disk 23 at an angle to longitudinal valve axis 2, separating along the walls of outlet openings 42 facing inlet opening 40. Individual, complex overall jet shapes with different quantity distributions are provided by combining multiple individual jets, which can be aligned, for example, asymmetrically with one another and can be produced by a specific orientation and alignment of inlet and outlet openings 40 and 42 and cavities 41.

The S pattern within perforated disk 23, which has multiple, intense flow diversions, imposes a strong, atomization-promoting turbulence on the flow. The velocity gradient across the flow is especially strong as a result. It is an expression of the variation in velocity across the flow, with the velocity being much higher in the center of the flow than it is near the walls. The elevated shear stresses in the fluid resulting from the differences in velocity help break down the fluid into fine droplets near outlet openings 42. Because the flow is partially separated at the outlet, it does not stabilize due to the lack of contour guidance. The fluid velocity is especially high on the separated side, while the fluid velocity toward the side of outlet opening 42 decreases as the flow is applied. The atomization-promoting turbulences and shear stresses are therefore not eliminated at the outlet.

The S pattern or flow separation at the outlet produces a fine-scale (high frequency) turbulence in the fluid with lateral vibrations, causing the jet or jets to break down into correspondingly fine droplets immediately upon exiting perforated disk 23. The higher the shear stresses produced by the turbulence, the greater the spread of flow vectors.

Perforated disk 23 shown in FIGS. 2 and 3 is only one embodiment of the design of opening geometries for multilayer electroplated perforated disks. Note, in particular, that countless other opening contours can also be produced, such as triangular, square, rectangular, polygonal, round, semicircular, elliptical, curved, sickle-shaped, cross-shaped, tunnel mouth-like, bat-shaped, meandering, gear-like, bone-shaped, T-shaped, ring segment-shaped, and V-shaped contours, any combination of which is also possible as inlet openings 40 and outlet openings 42 as well as cavities 41. Likewise, the arrangement and shape of gas supply openings 43 can be varied as desired.

Figure 4:
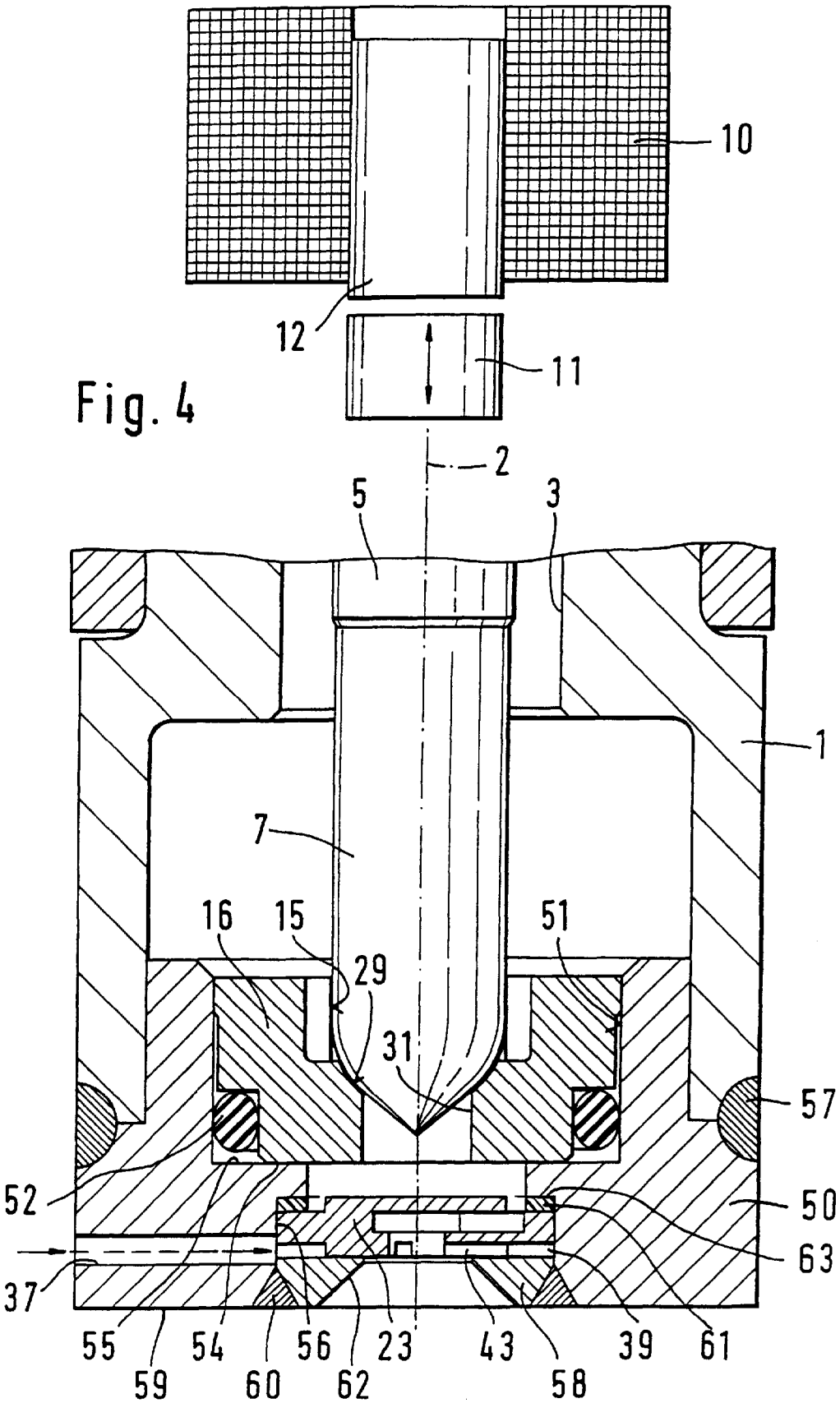
FIG. 4 shows a partial illustration of a second exemplary embodiment of the injection valve with the perforated disk according to the present invention.

FIG. 4 shows a partial view of an injection valve for fuel injection systems of mixture-compressing internal combustion engines with externally supplied ignition as a second embodiment, with an injection valve of this type being suitable for injecting a fuel directly into the combustion chamber of an internal combustion engine of this type. According to this embodiment shown in FIGS. 4–6, the parts that are the same or have the same functions as those in the embodiment shown in FIGS. 1 through 3 are identified by the same reference numbers. All previously explained aspects relating to the production technology also apply to perforated disks 23 illustrated in FIGS. 5 and 6, which are designed as swirl atomizer disks produced by multilayer electroplating.

FIG. 4 shows a further method for installing an atomizer disk 3 according to the present invention, in which an additional holding element 50, which projects into segmented longitudinal opening 3 of valve seat carrier 1 is provided on the end of the valve. Valve seat body 16 is inserted into an inner opening 51 in holding element 50 so that it is sealed by a gasket 52 and is attached, for example, by laser welding, pressing, shrinking, hard soldering, diffusion soldering, or magnetic forming, with its lower end face 54 being supported on a stage 55 in holding element 50. Viewed from the downstream direction, opening 51 extends cylindrically and rotationally symmetrically to longitudinal valve axis 2 in the direction of stage 55 with a large diameter than the diameter upstream from stage 55. A lower segment 56 of opening 51 is used to hold atomizer disk 23, which is designed as a swirl disk. Atomizer disk 23 is designed so that four electrodeposited layers or functional plates, each having different opening contours, adhere to one another, with at least one of the two middle layers 46, 46' defining an outer joining diameter of atomizer disk 23 so that the latter fits snugly into opening 51 in holding element 50. Holding element 50 and valve seat carrier 1 are permanent connected, for example, by a circumferential welded seam 57. Valve seat body 16, with its guide opening 15, is also used to guide valve needle 5.

Downstream from atomizer disk 23, another disk-shaped, cylindrical supporting element 58, against which lower functional plate 45 of atomizer disk 23 rests, is arranged in opening 51. On the side opposite supporting element 58, a ring-shaped gasket 61, on which atomizer disk 23 rests and which is pressed against a shoulder 63 of opening 51 from below when supporting element 58 is inserted, is arranged at the height of upper functional plate 47. Gasket 61 is advantageously made of a soft metal such as aluminum or copper. However, a gasket 61 made of plastic or rubber is also conceivable. Supporting element 58 is flush, for example, with a lower end face 59 of holding element 50, with a welded seam 60 in the region of end face 59 being used for attachment. A central outlet opening 62 in supporting element 58 is designed, for example, so that it increases in diameter conically in the downstream direction, so as not to disturb the spread of the jet. Atomizer disk 23 can be very easily installed in holding element 50 from below.

At least one flow channel 37 for a gas, which runs for example from the outer circumference of holding element 50 to opening 51, is provided in holding element 50. At the back of flow channel 37, the gas flow enters an annular chamber 39 formed in opening 51 which is limited by atomizer disk 23, supporting element 58, and the inner wall of holding element 50. Inside this annular chamber 39, the gas flow is distributed largely evenly over the circumference.

The lower layer or functional plate 45 of atomizer disk 23 is provided with the arrangement 43 for supplying gas in the direction of its spray geometry, with the gas coming from flow channel 37 and annular chamber 39 entering this arrangement 43 and flowing through them largely perpendicular to longitudinal valve axis 2.

Figure 5:
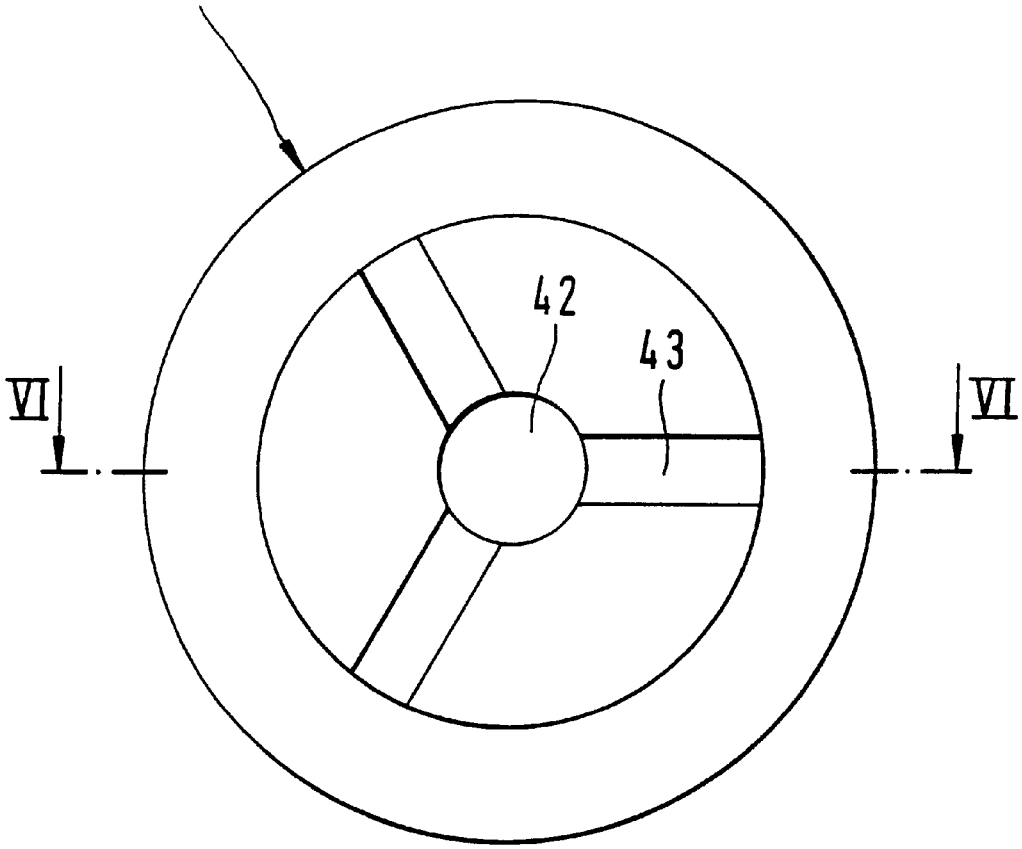
FIG. 5 shows a bottom view of the perforated disk illustrated in FIG. 4.
Figure 6:
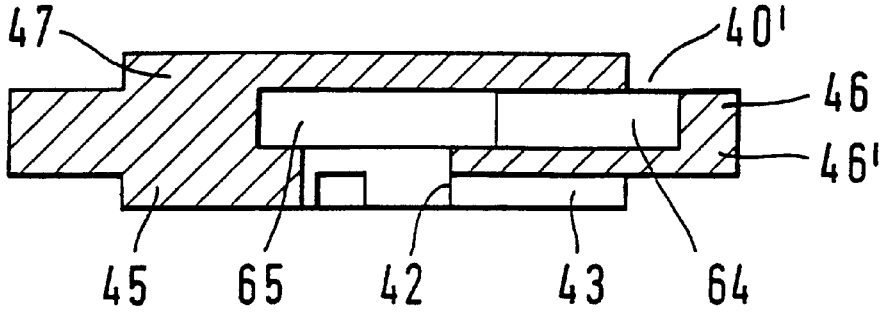
FIG. 6 shows a cutaway view along line VI—VI of the perforated disk illustrated in FIG. 5.

FIG. 5 shows a preferred embodiment, viewed from below, of an atomizer disk 23 with a swirling motion being applied to the flowing fuel. Atomizer disk 23 is designed as a flat, circular component that has multiple, for example four, functional plates arranged consecutively in the axial direction. FIG. 6, in particular, which shows a cutaway view along a line VI—VI of the representation in FIG. 5, illustrates the design of atomizer disk 23 with its four functional plates, with lower functional plate 45, which is applied first and corresponds to the first layer deposited, having a smaller outer diameter than the two subsequent middle functional plates 46' and 46. Upper functional plate 47, for example, has an outer diameter that corresponds to that of lower functional plate 45.

Upper functional plate 47 has multiple inlet areas 40'. For example, a circular outlet opening 42, into which empty, for example, three slot-shaped gas supply openings 43, offset from one another by 120°, is provided in downstream middle functional plate 46' and lower functional plate 45. Outlet opening 42 can also be segmented between functional plates 46' and 45, in which case it is advantageous to select a diameter for outlet opening 42 in lower functional plate 45 that is larger than the diameter of middle functional plate 46'. In this case, a ring-shaped hollow space for uniform distribution of the gas flow over the jet circumference forms between the fuel jet and the wall of outlet opening 42 in functional plate 45.

By selectively distributing gas supply openings 42 across the circumference of the disk, the jet cross-section of the fuel to be sprayed can be selectively changed when the gas is supplied. With the arrangement of three gas supply openings 43 shown in FIG. 5, a hollow conical jet can be changed to a jet with a triangular cross-section by supplying the gas. The number of gas supply openings 43 and the distribution of gas supply openings 43 over the disk circumference can be varied to produce other desired jet shapes. When atomizer disk 23 is installed, gas supply openings 43 are covered from below by supporting element 58, creating gas supply channels.

To ensure that the fluid flows from inlet areas 40' to outlet opening 42, multiple swirl channels 64, which empty, for example, tangentially into a central swirl chamber 65 above outlet opening 42, are provided in upstream, middle functional plate 46. Because gas supply openings 43 empty into outlet opening 42 tangentially and not radially, it is possible to produce an additional swirling motion in the gas as well. This swirling motion can run in the same or the opposite direction from the swirling motion of the fuel. If the swirling motion is in the opposite direction, the relative velocities are the highest between the rotating gas stream and the rotating jet surface. This is particularly helpful in breaking down the fuel jet into small droplets.

Gas supply openings 43 or gas supply channels formed when perforated disk or atomizer disk 23 is installed have narrow cross-sections which are used for metering the gas. In addition, the narrow cross-section accelerates the gas so that the gas strikes the fuel to be sprayed at a higher velocity in the region of outlet openings 42, surrounding and atomizing the fuel until very fine droplets form. The striking pulse and mixture of the gas with the fuel produce very effective atomization of the fuel. This causes a largely homogenous fuel-gas mixture to form.

Described perforated disks or atomizer disks 23 are provided not only for use in injection valves. They can also be used, for example, in spray-painting nozzles, inhalers, ink-jet printers, or freeze-drying processes, to spray or inject fluids such as drinks, and to atomize medicines. Perforated disks 23 produced by multilayer electroplating and designed as S-type disks or swirl atomizer disks with gas supply are generally suitable for producing fine sprays, e.g., with wide angles.

What is claimed is:

1. A perforated disk of at least one metallic material, the perforated disk comprising:

a single part with at least one layer having a passage for facilitating a flow of a fluid, the passage extending through the single part, the single part including a plurality of functional plates, the plurality of functional plates including an upper functional plate and a lower functional plate, the upper functional plate including at least one inlet opening of the passage, the lower functional plate including at least one outlet opening of the passage, the single part including at least one gas supply opening in communication with the passage;

wherein each of the plurality of functional plates is electrodeposited onto each adjacent functional plate in an electrodepositing operation to thereby form the single part.

2. The perforated disk according to claim 1, wherein the arrangement is provided in the lower functional plate.

3. The perforated disk according to claim 1, wherein the gas supply openings extend from an outer circumference of the perforated disk to an interior part of the perforated disk, each of the gas supply openings having a shape of a slot.

4. The perforated disk according to claim 3, wherein the gas supply openings extend radially to a centrally-positioned opening of the at least one outlet opening.

5. The perforated disk according to claim 3, wherein the gas supply openings extend tangentially to a centrally-positioned opening of the at least one outlet opening.

6. The perforated disk according to claims 3, wherein the gas supply openings include the at least one outlet opening which faces away from the outer circumference of the perforated disk.

7. The perforated disk according to claim 6, wherein the at least one outlet opening includes a plurality of outlet openings, and wherein a first amount of the outlet openings equals to a second amount of the gas supply openings.

8. The perforated disk according to claim 1, further comprising:

at least one middle functional plate including a cavity, the at least one inlet opening and the at least one outlet opening being connected to the cavity.

9. The perforated disk according to claim 8, wherein the at least one middle functional plate includes multiple swirl channels which extend to a swirl chamber.

10. The perforated disk according to claim 8, wherein the cavity is dimensioned to completely cover the at least one inlet opening and the at least one outlet opening in a projectional view.

11. The perforated disk according to claim 8, wherein the at least one middle functional plate has an outer diameter which is larger than an outer diameter of the lower and upper functional plates.

12. The perforated disk according to claim 1, wherein one of the inlet and outlet openings does not cover another one of the inlet and outlet openings at any point along a projection into a plane of the perforated disk, and wherein the at least one inlet opening is provided at a predetermined distance from the at least one outlet opening.

13. The perforated disk according to claim 1, wherein the upper functional plate is disposed in a particular area which has a first diameter, wherein the lower functional plate is surrounded by a base area which has a second diameter, and wherein the first diameter is smaller than the second diameter.

14. The perforated disk according to claim 1, wherein the perforated disk is provided for an injection valve.

15. The perforated disk according to claim 1, wherein the functional plates are electrodeposited on one another using a multilayer electroplating procedure.

16. An atomizer disk of at least one metallic material, the atomizer disk comprising:

a single part with at least one layer having a passage for facilitating a flow of a fluid, the passage extending through the single part, the single part including a plurality of functional plates, the plurality of functional plates including an upper functional plate and a lower functional plate, the upper functional plate including at least one inlet opening of the passage, the lower functional plate including at least one outlet opening of the passage, the single part including at least one gas supply opening in communication with the passage;

wherein each of the plurality of functional plates is electrodeposited onto each adjacent functional plate in an electrodepositing operation to thereby form the single part.

17. An injection valve having a longitudinal valve axis, comprising:

a valve seat surface;

a valve closing member cooperating with the valve seat surface; and a perforated disk composed of at least one metallic material and situated downstream from the valve seat surface, the perforated disk including:

a single part with at least one layer having a passage for facilitating a flow of a fluid, the passage extending through the single part, the single part including a plurality of functional plates, the plurality of functional plates including an upper functional plate and a lower functional plate, the upper functional plate including at least one inlet opening of the passage, the lower functional plate including at least one outlet opening of the passage, the single part including at least one gas supply opening in communication with the passage;

wherein each of the plurality of functional plates is electrodeposited onto each adjacent functional plate in an electrodepositing operation to thereby form the single part.

18. The injection valve according to claim 17, further comprising:

a valve seat body including the valve seat surface for connecting to a further outlet opening in a downstream direction, wherein the upper functional plate is disposed in a particular area of the perforated disk, the particular area having a first outer diameter, wherein the lower functional plate is surrounded by a base area of the perforated disk, the base area having a second outer diameter, the first diameter being smaller than the second diameter, and wherein the particular area extends into the further outlet opening, and the base area is disposed against a lower end face of the valve seat body.

19. The injection valve according to claim 18, wherein the further outlet opening is provided in segments.

20. The injection valve according to claim 17, further comprising:

a holding element; and a valve seat body having the valve seat surface, wherein the valve seat body and the perforated disk are provided in the holding element.

21. The injection valve according to claim 20, further comprising:

a supporting element permanently connected to the holding element, wherein the lower functional plate is disposed on the supporting element.

22. The injection valve according to claim 20, wherein the holding element includes at least one flow channel for providing a gas therethrough.

23. The injection valve according to claim 17, wherein the functional plates are electrodeposited on one another using a multilayer electroplating procedure.

24. An injection valve having a longitudinal valve axis, comprising:

a valve seat surface;

a valve closing member cooperating with the valve seat surface;

a perforated disk composed of at least one metallic material and situated downstream from the valve seat surface, the perforated disk including a single part with at least one layer having a passage for facilitating a flow of a fluid, the passage extending through the single part, the single part including a plurality of functional plates, the plurality of functional plates including an upper functional plate and a lower functional plate, the upper functional plate including at least one inlet opening of the passage, the lower functional plate including at least one outlet opening of the passage, the single part including at least one gas supply opening in communication with the passage;

a valve seat body including the valve seat surface for connecting to a further outlet opening in a downstream direction; and a perforated disk holder clamping the perforated disk to the valve seat body;

wherein each of the plurality of functional plates is electrodeposited onto each adjacent functional plate in an electrodepositing operation to thereby form the single part;

wherein the upper functional plate is disposed in a particular area of the perforated disk, the particular area having a first outer diameter;

wherein the lower functional plate is surrounded by a base area of the perforated disk, the base area having a second outer diameter, the first diameter being smaller than the second diameter; and wherein the particular area extends into the further outlet opening, and the base area is disposed against a lower end face of the valve seat body.

25. The injection valve according to claim 24, wherein the perforated disk holder has a cup shape and includes a base and a retaining edge portion, the base including a passage, the retaining edge extending in a perpendicular direction with respect to the base.

26. The injection valve according to claim 25, wherein the valve seat body has at least one depression on an outer circumference of the valve seat body, and further comprising:

a valve seat carrier limiting the at least one depression to form at least one flow channel, the at least one flow channel providing a gas therethrough.

27. The injection valve according to claim 26, wherein the at least one depression includes a flattened abrasion portion.

28. An injection valve having a longitudinal axis, comprising:

a valve seat surface;

a valve closing member cooperating with the valve seat surface; and an atomizer disk composed of at least one metallic material and situated downstream from the valve seat surface, the atomizer disk including:

a single part with at least one layer having a passage for facilitating a flow of a fluid, the passage extending through the single part, the single part including a plurality of functional plates, the plurality of functional plates including an upper functional plate and a lower functional plate, the upper functional plate including at least one inlet opening of the passage, the lower functional plate including at least one outlet opening of the passage, the single part including at least one gas supply opening in communication with the passage;

wherein each of the plurality of functional plates is electrodeposited onto each adjacent functional plate in an electrodepositing operation to thereby form the single part.

* * * * *